US007663595B2

(12) United States Patent
Tung

(10) Patent No.: US 7,663,595 B2
(45) Date of Patent: Feb. 16, 2010

(54) COMMON VOLTAGE ADJUSTING CIRCUIT FOR LIQUID CRYSTAL DISPLAY

(75) Inventor: Chien-Fan Tung, Miao-Li (TW)

(73) Assignee: Innolux Display Corp., Miao-Li County (TW)

( * ) Notice: Subject to any disclaimer, the term of this patent is extended or adjusted under 35 U.S.C. 154(b) by 587 days.

(21) Appl. No.: 11/644,307

(22) Filed: Dec. 21, 2006

(65) Prior Publication Data

US 2007/0146263 A1 Jun. 28, 2007

(30) Foreign Application Priority Data

Dec. 22, 2005 (CN) ..... 2005 1 0121010

(51) Int. Cl.
*G09G 3/36* (2006.01)

(52) U.S. Cl. ..... 345/100; 345/98

(58) Field of Classification Search ..... 345/87–100, 345/204

See application file for complete search history.

(56) References Cited

U.S. PATENT DOCUMENTS 4,387,457 A * 6/1983 Munter ..... 370/267
4,754,270 A * 6/1988 Murauchi ..... 345/668
5,216,756 A * 6/1993 Senba ..... 345/440
5,414,719 A * 5/1995 Iwaki et al. ..... 714/785
5,434,949 A * 7/1995 Jeong ..... 704/270
5,596,349 A * 1/1997 Kobayashi et al. ..... 345/690
6,046,725 A * 4/2000 Yoon ..... 345/605
6,137,462 A * 10/2000 Kim ..... 345/94
6,404,259 B1 * 6/2002 Busse ..... 327/293
6,822,642 B2 11/2004 Chou
7,088,324 B2 * 8/2006 Sakaguchi et al. ..... 345/87
2004/0252891 A1 * 12/2004 Sasaki ..... 382/232
2006/0125764 A1 * 6/2006 Furuhashi et al. ..... 345/98

* cited by examiner

*Primary Examiner*—Nitin Patel
(74) *Attorney, Agent, or Firm*—Wei Te Chung

(57) ABSTRACT

A common voltage adjusting circuit (200) includes a delta adder (21), a sigma adder (22), a sigma latch (23), and a quantization circuit (24). The delta adder includes a first input terminal configured for receiving a binary signal, a second input terminal, and an output terminal. The sigma adder includes a first input terminal connected to the output terminal of the delta adder, a second input terminal, and an output terminal. The sigma latch includes a first input terminal connected to the output terminal of the sigma adder, and an output terminal connected to the second input terminal of the delta adder and the second input terminal of the sigma adder. The quantization circuit includes a first input terminal connected to the output of the sigma latch, and an output terminal connected to a common electrode of a TFT-LCD.

11 Claims, 1 Drawing Sheet

COMMON VOLTAGE ADJUSTING CIRCUIT FOR LIQUID CRYSTAL DISPLAY

FIELD OF THE INVENTION

The present invention relates a common voltage adjusting circuit used in a thin film transistor liquid crystal display (TFT-LCD).

GENERAL BACKGROUND

A TFT-LCD has the advantages of portability, low power consumption, and low radiation, and has been widely used in various portable information products such as notebooks, personal digital assistants (PDAs), video cameras and the like. Furthermore, the TFT-LCD is considered by many to have the potential to completely replace CRT (cathode ray tube) monitors and televisions.

The TFT-LCD usually includes a color filter (CF) substrate, a thin film transistor (TFT) array substrate, and a liquid crystal layer sandwiched between the two substrates. The TFT array substrate includes a plurality of gate lines that are parallel to each other and extend along a first direction, and a plurality of data line that are parallel to each other and extend along a second direction orthogonal to the first direction. The smallest rectangular area formed by any two adjacent gate lines together with any two adjacent data lines defines a pixel region thereat.

In each pixel region, a TFT is provided in the vicinity of a respective point of intersection of one of the gate lines and one of the data lines. The TFT functions as a switching element. A pixel electrode is connected to the TFT. The CF substrate includes a plurality of common electrodes, each common electrode corresponding to a respective one of the pixel electrodes on the TFT array substrate.

When the TFT-LCD works, gradation voltages are applied to the pixel electrodes and a common voltage is applied to the common electrodes. Thus an electric field is applied to the liquid crystal molecules of the liquid crystal layer. At least some of the liquid crystal molecules change their orientations, whereby the liquid crystal layer provides anisotropic transmittance of light therethrough. Thus the amount of the light penetrating the CF substrate is adjusted by controlling the strength of the electric field. In this way, desired pixel colors are obtained at the CF substrate, and the arrayed combination of the pixel colors provides an image viewed on a display screen of the TFT-LCD.

If an electric field between the pixel electrodes and the common electrodes continues to be applied to the liquid crystal material in one direction, the liquid crystal material may deteriorate. Therefore, in order to avoid this problem, gradation voltages that are provided to the pixel electrode are switched from a positive value to a negative value with respect to the common voltage. This technique is referred to as an inversion drive method.

However, the common voltage may vary in different environmental temperatures. But the inversion drive method needs the common voltage to be a predetermined constant value in order to prevent appearing flicker on the screen of the TFT-LCD. Thus a common voltage adjusting circuit is needed.

FIG. 2 is a diagram of a typical common voltage adjusting circuit of a TFT-LCD. The common voltage adjusting circuit 100 includes a power supply V1, an output terminal V0, a first resistor R1, a second resistor R2, a third resistor R3, a fourth resistor R4, a fifth resistor R5, a sixth resistor R6, a seventh resistor R7, an eighth resistor R8, a ninth resistor R9, a tenth resistor R10, a first switch S1, a second switch S2, a third switch S3, a fourth switch S4, and a comparator 10. Each of the switches S1, S2, S3, S4 includes a first terminal 1, a second terminal 2, and a third terminal 3.

The ninth resistor R9 is connected between the power supply V1 and ground. The fourth resistor R4, the first resistor R1, the second resistor R2, and the third resistor R3 are connected in series between ground and the power supply V1, wherein the fourth resistor R4 is connected directly to ground.

A connecting node between the first resistor R1 and the fourth resistor R4 is connected to the third terminal 3 of the first switch S1 via the fifth resistor R5. A connecting node between the first resistor R1 and the second resistor R2 is connected to the third terminal 3 of the second switch S2 via the sixth resistor R6. A connecting node between the second resistor R2 and the third resistor R3 is connected to the third terminal 3 of the third switch S3 via the seventh resistor R7. The power supply V1 is connected to the third terminal 3 of the fourth switch S4 via the eighth resistor R8. The second terminals 2 of the switches S1, S2, S3, S4 are connected to ground. The first terminals 1 of the switches S1, S2, S3, S4 are connected to a noninverting input of the comparator 10. An inverting input of the comparator 10 is connected to ground. The output of the comparator 10 is connected to the output terminal V0. The third terminals 3 of the switches S1, S2, S3, S4 are used to receive four binary signals B0, B1, B2, B3 respectively.

Resistances of the first resistor R1, the second resistor R2, and the third resistor R3 are equivalent to each other. Resistances of the fourth resistor R4, the fifth resistor R5, the sixth resistor R6, the seventh resistor R7, the eighth resistor R8, and the ninth resistor R9 are equivalent to each other.

When four binary signals B0, B1, B2, B3 are equal to "1" respectively, the third terminal 3 and the first terminal 1 of each switch S1, S2, S3, S4 is electrically connected. The output of the comparator 10 provides the maximal adjusting voltage to the output terminal V0. The potential of the maximal adjusting voltage is approximately equal to that of the power supply V1.

When the four binary signals B0, B1, B2, B3 are equal to "0" respectively, the third terminal 3 and the second terminal 2 of each switch S1, S2, S3, S4 are electrically connected. The output of the comparator 10 provides a minimal adjusting voltage to the output terminal V0. The potential of the minimal adjusting voltage is approximately equal to zero volts.

When the four binary signals B0, B1, B2, B3 are different values respectively such as "0" or "1", the output of the comparator 10 provides a middle adjusting voltage to the output terminal V0. The potential of the middle adjusting voltage is in the range of 0-V1. Thus the common voltage adjusting circuit 100 transforms different binary signals B0, B1, B2, B3 therein, for respectively adjusting voltages and providing the adjusting voltages to control the common voltage of the TFT-LCD.

However, the parameters of the elements of the common voltage adjusting circuit 100, such as the first resistor R1, the second resistor R2, the third resistor R3, and the fourth resistor R4, vary in different environmental temperatures. Therefore voltages respectively at the connecting node between the first resistor R1 and the fourth resistor R4, the connecting node between the first resistor R1 and the second resistor R2, and the connecting node between the second resistor R2 and the third resistor R3 vary with different environmental temperatures. Thus, a voltage provided to the noninverting input of the comparator 10 cannot be accurately controlled, and the adjusting voltage generated by the comparator 10 cannot be accurately controlled.

What is needed, therefore, is a common voltage adjusting circuit of a TFT-LCD that can overcome the above-described deficiencies.

SUMMARY

In one preferred embodiment, a common voltage adjusting circuit of a TFT-LCD includes a delta adder, a sigma adder, a sigma latch, and a quantization circuit. The delta adder includes a first input terminal configured for receiving a binary signal, a second input terminal, and an output terminal. The sigma adder includes a first input terminal connected to the output terminal of the delta adder, a second input terminal, and an output terminal. The sigma latch includes a first input terminal connected to the output terminal of the sigma adder, a clock input terminal, a reset terminal, and an output terminal connected to the second input terminal of the delta adder and the second input terminal the sigma adder. The quantization circuit includes a first input terminal connected to the output of the sigma latch, a clock input terminal, a reset terminal, and an output terminal connected to a common electrode of a TFT-LCD.

Other advantages and novel features will become more apparent from the following detailed description when taken in conjunction with the accompanying drawings.

DETAILED DESCRIPTION OF PREFERRED EMBODIMENT

Figure 1:
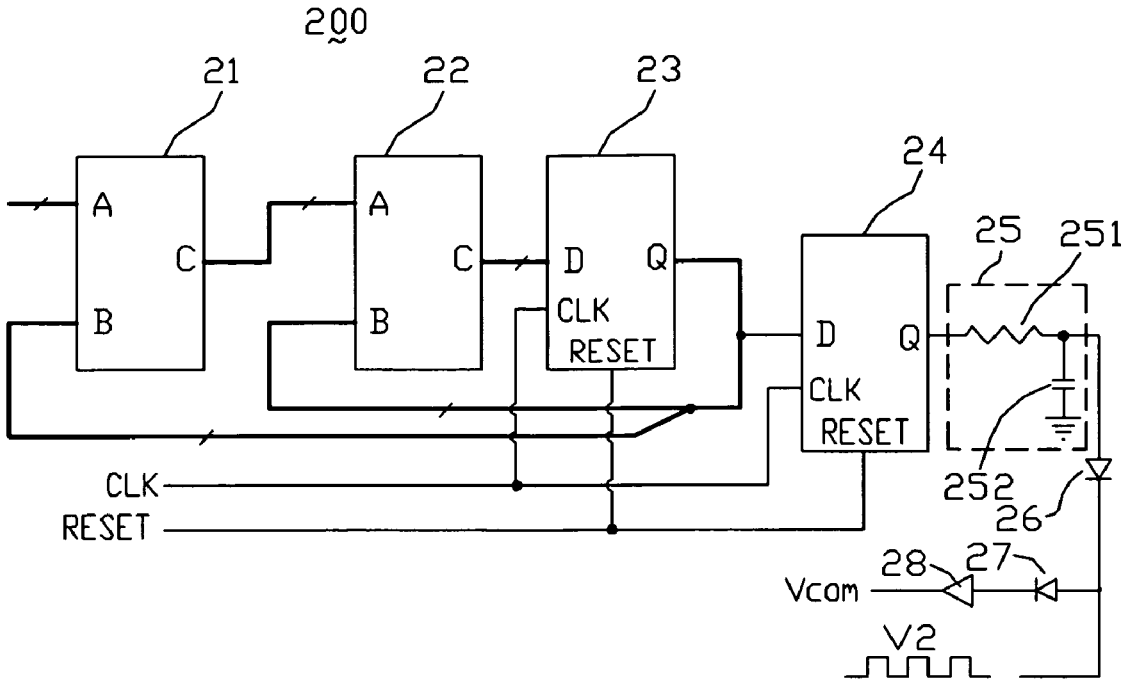
FIG. 1 is a diagram of a common voltage adjusting circuit of a TFT-LCD according to an exemplary embodiment of the present invention.
Figure 2:
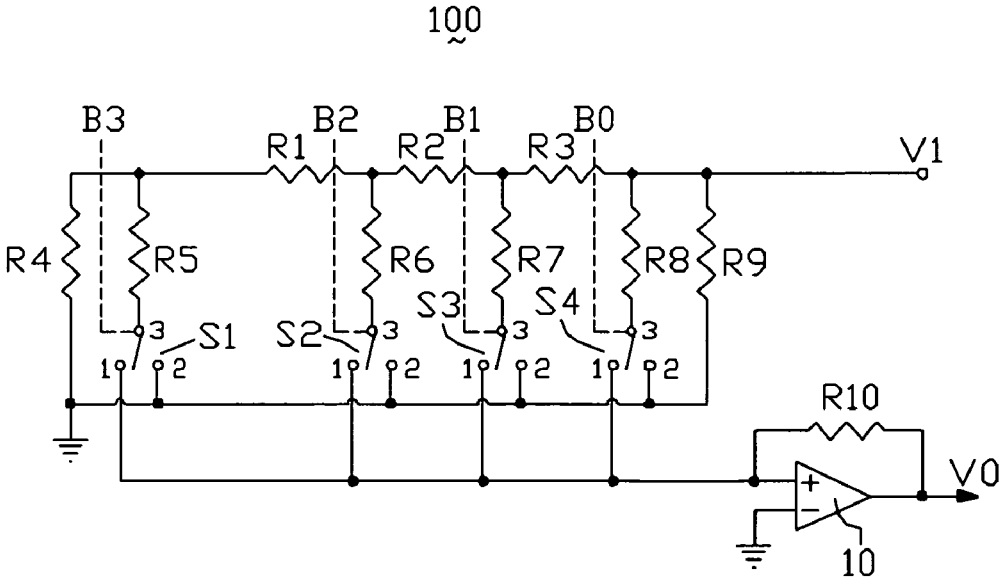
FIG. 2 (RELATED ART)
FIG. 2 is a diagram of a conventional common voltage adjusting circuit of a TFT-LCD.

FIG. 1 is a diagram of a common voltage adjusting circuit of a TFT-LCD according to an exemplary embodiment of the present invention. The common voltage adjusting circuit 200 includes a delta adder 21, a sigma adder 22, a sigma latch 23, a quantization circuit 24, a low-pass filter 25, a first diode 26, a second diode 27, and a buffer 28.

The delta adder 21 includes a first input terminal "A", a second input terminal "B", and an output terminal "C". The sigma adder 22 includes a first input terminal "A", a second input terminal "B", and an output terminal "C". The sigma latch 23 includes a first input terminal "D", a clock input terminal "CLK", a reset terminal "RESET", and an output terminal "Q". The quantization circuit 24 includes a first input terminal "D", a clock input terminal "CLK", a reset terminal "RESET", and an output terminal "Q".

The low-pass filter 25 includes an input terminal (not labeled), an output terminal (not labeled), a resistor 251, and a capacitor 252. The resistor 251 and the capacitor 252 are connected in series between the input terminal and ground. A connecting node between the resistor 251 and the capacitor 252 is defined to be the output terminal of the low-pass filter 25.

The clock input terminals "CLK" of the sigma latch 23 and the quantization circuit 24 are used to receive a clock signal CLK from a timing control circuit of the TFT-LCD. The reset terminals "RESET" of the sigma latch 23 and the quantization circuit 24 are used to receive a reset signal RESET from the timing control circuit.

The first input terminal "A" of the delta adder 21 is defined to be the input terminal of the common voltage adjusting circuit 200. The first input terminal "A" of the delta adder 21 receives binary signals provided by an external circuit (not shown) of the TFT-LCD. The binary signals can be four bit signals, eight bit signals or twelve bit signals.

The second input terminal "B" of the delta adder 21 is connected to the output terminal "Q" of the sigma latch 23. The output terminal "C" of the delta adder 21 is connected to the first input terminal "A" of the sigma adder 22. The second input terminal "B" of the sigma adder 22 is connected to the output terminal "Q" of the sigma latch 23. The output terminal "C" of the sigma adder 22 is connected to the first input "D" of the sigma latch 23. The output terminal "Q" of the sigma latch 23 is connected to the first input terminal "D" of the quantization circuit 24.

The output terminal "Q" of the quantization circuit 24 is connected to the input terminal of the low-pass filter 25. The output terminal of the low-pass filter 25 is connected to a common electrode Vcom of the TFT-LCD via a positive terminal of the first diode 26, a negative terminal of the first diode 26, a positive terminal of the second diode 27, a negative terminal of the second diode 27, and the buffer 28 in series. A connecting node between the negative terminal of the first diode 26 and the positive terminal of the second diode 27 is connected to an external pulse generator (not shown) for receiving a pulse signal V2. A width of the pulse signal V2 is equal to 3.3 volts.

When the input terminal of the common voltage adjusting circuit 200 receives an eight bit binary signal which is equal to "0000 0000" from the external circuit, then the delta adder 21, the sigma adder 22, and the sigma latch 23 respectively output the eight bit binary signal "0000 0000". Accordingly, the quantization circuit 24 outputs a voltage which is equal to zero volts. Thus the zero voltage is provided to the common electrode Vcom of the TFT-LCD via the low-pass filter 25, the diodes 26, 27, and the buffer 28 in series. The zero voltage provided to the common electrode is defined to be the minimal common voltage.

When the input terminal of the common voltage adjusting circuit 200 receives an eight bit binary signal which is equal to "1111 1111" from the external circuit, then the delta adder 21, the sigma adder 22, and the sigma latch 23 respectively output the eight bit binary signal "1111 1111". Accordingly, the quantization circuit 24 outputs a voltage Vcco, which is equal to a maximal common voltage. Thus the voltage Vcco is provided to the common electrode Vcom of the TFT-LCD via the low-pass filter 25, the diodes 26, 27, and the buffer 28 in series.

When the input terminal of the common voltage adjusting circuit 200 receives an eight bit binary signal which is in the range of "0000 0000" and "1111 1111" from the external circuit, then the delta adder 21, the sigma adder 22, and the sigma latch 23 respectively output the eight bit binary signal. Accordingly, the quantization circuit 24 outputs a voltage Vc, which is equal to $X \cdot Vcco/256$ ($1 \leqq x < 256$, where the x is a natural number). Thus the voltage Vc (which is in the range from zero volts to the maximal common voltage Vcco) is provided to the common electrode Vcom of the TFT-LCD via the low-pass filter 25, the diodes 26, 27, and the buffer 28 in series. The potential of the voltage Vc is determined by the value of the eight bit binary signal inputted to the input terminal of the common voltage adjusting circuit 200.

Because the delta adder 21, the sigma adder 22, the sigma latch 23, and the quantization circuit 24 are digital circuits, voltages provided to the common electrode Vcom of the TFT-LCD can be accurately controlled and are not influenced by environmental temperatures.

It is to be understood, however, that even though numerous characteristics and advantages of the present embodiment have been set out in the foregoing description, together with details of the structures and functions of the embodiment, the disclosure is illustrative only, and changes may be made in detail, especially in matters of shape and arrangement of parts within the principles of the invention to the full extent indicated by the broad general meaning of the terms in which the appended claims are expressed.

What is claimed is:

1. A common voltage adjusting circuit of a thin film transistor liquid crystal display (TFT-LCD), comprising:

a delta adder comprising a first input terminal configured for receiving a binary signal, a second input terminal, and an output terminal;

a sigma adder comprising a first input terminal connected to the output terminal of the delta adder, a second input terminal, and an output terminal;

a sigma latch comprising a first input terminal connected to the output terminal of the sigma adder, a clock input terminal, a reset terminal, and an output terminal connected to the second input terminal of the delta adder and the second input terminal of the sigma adder; and a quantization circuit comprising a first input terminal connected to the output of the sigma latch, a clock input terminal, a reset terminal, and an output terminal configured to be connected to a common electrode of a TFT-LCD.

2. The common voltage adjusting circuit as claimed in claim 1, further comprising:

a low-pass filter;

a first diode connected to the low-pass filter;

a second diode connected to the first diode; and a buffer connected to the second diode;

wherein the output terminal of the quantization circuit is connected to the low-pass filter, the first diode, the second diode, and the buffer in series, and the buffer is configured to be connected to the common electrode of the TFT-LCD.

3. The common voltage adjusting circuit as claimed in claim 2, wherein the low-pass filter comprises a resistor and a capacitor, the resistor and the capacitor being connected in series between the output terminal of the quantization and ground, a connecting node between the resistor and the capacitor being connected to a positive terminal of the first diode.

4. The common voltage adjusting circuit as claimed in claim 2, wherein a negative terminal of the first diode is connected to a positive terminal of the second diode.

5. The common voltage adjusting circuit as claimed in claim 2, further comprising a pulse power supply provided to a positive terminal of the second diode.

6. The common voltage adjusting circuit as claimed in claim 5, wherein a width of the pulse power supply is approximately equal to 3.3 volts.

7. The common voltage adjusting circuit as claimed in claim 1, wherein the clock input terminal of the sigma latch and the clock input terminal of the quantization circuit are respectively configured for receiving a clock signal from a timing control circuit of the TFT-LCD.

8. The common voltage adjusting circuit as claimed in claim 1, wherein the reset terminal of the sigma latch and the reset terminal of the quantization circuit are respectively configured for receiving a reset signal from a timing control circuit of the TFT-LCD.

9. The common voltage adjusting circuit as claimed in claim 1, wherein the binary signal is a four bit binary signal.

10. The common voltage adjusting circuit as claimed in claim 1, wherein the binary signal is an eight bit binary signal.

11. The common voltage adjusting circuit as claimed in claim 1, wherein the binary signal is a twelve bit binary signal.

* * * * *

UNITED STATES PATENT AND TRADEMARK OFFICE

CERTIFICATE OF CORRECTION

PATENT NO. : 7,663,595 B2
APPLICATION NO. : 11/644307
DATED : February 16, 2010
INVENTOR(S) : Chien-Fan Tung It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 644 days.

Signed and Sealed this

Thirtieth Day of November, 2010

David J. Kappos

David J. Kappos
*Director of the United States Patent and Trademark Office*